United States Patent [19]

Bloyce et al.

[11] Patent Number: 4,674,684

[45] Date of Patent: Jun. 23, 1987

[54] SUPPORT AND DRIVE MEMBERS SUITABLE, FOR EXAMPLE, FOR USE IN SHOWER UNITS OF PAPERMAKING MACHINES

[75] Inventors: Lionel T. Bloyce, Maidenhead; Michael J. Morley, Bray, both of England

[73] Assignee: Albany International Corp., Menands, N.Y.

[21] Appl. No.: 865,574

[22] Filed: May 15, 1986

Related U.S. Application Data

[63] Continuation of Ser. No. 533,878, Sep. 20, 1983, abandoned.

[30] Foreign Application Priority Data

Oct. 4, 1982 [GB] United Kingdom ..... 8228289

[51] Int. Cl.[4] ..... B05B 3/18; D21F 1/32

[52] U.S. Cl. ..... 239/123; 239/132.1; 239/751; 239/752; 239/275; 15/104.03; 15/104.05; 15/246; 74/89.15; 74/458; 162/277

[58] Field of Search ..... 239/114, 115, 123, 132.1, 239/178, 184, 186, 195, 225, 226, 264, 751, 752; 162/272, 275, 277, 278; 74/89.15, 458; 104/56, 57, 167; 15/104.03, 104.04, 104.05, 246

[56] References Cited

U.S. PATENT DOCUMENTS

| | | | |
|---|---|---|---|
| 1,888,575 | 11/1932 | Scofield . | |
| 2,971,699 | 2/1961 | Reiss | 239/225 X |
| 3,169,706 | 2/1965 | Ross | 239/186 |
| 3,534,626 | 10/1970 | Elliott et al. | 74/124.8 |
| 3,808,980 | 5/1974 | Winiarski | 104/167 |
| 3,880,357 | 4/1975 | Baisch | 239/225 X |
| 4,226,129 | 10/1980 | Henderson | 74/89.15 |

FOREIGN PATENT DOCUMENTS

| | | | |
|---|---|---|---|
| 864991 | 3/1971 | Canada . | |
| 1962456 | 2/1971 | Fed. Rep. of Germany . | |
| 631558 | 11/1949 | United Kingdom | 162/277 |
| 1266739 | 3/1972 | United Kingdom . | |
| 2030893 | 4/1980 | United Kingdom | 239/225 |

OTHER PUBLICATIONS

Rabe, Kurt, "Dynamic Applications For Screw Threads," Product Engineering, Feb. 29, 1960, 43–46.

*Primary Examiner*—Andres Kashnikow
*Assistant Examiner*—MaryBeth O. Jones

[57] ABSTRACT

A support and driving member comprises an open framework comprising a helical strip (38) supported by a series of support members (39) extending longitudinally of the helical strip and internally thereof. The member may be incorporated in a shower unit that comprises a tubular housing (1) with a longitudinal slot (6), the driving member (16) being located coaxially within the housing and mounted for rotation about its longitudinal axis. A driving motor (15) housed in an end cap (8) has an output shaft (24) that rotates the member (16). Mounted on the member (16) for movement along the latter is a nozzle carrier (5) carrying an air nozzle (41) and a water nozzle that discharge through the slot (6). The nozzles are connected via flexible supply lines (SL) within the housing (1) to inlets (34) for treatment fluids.

6 Claims, 4 Drawing Figures

SUPPORT AND DRIVE MEMBERS SUITABLE, FOR EXAMPLE, FOR USE IN SHOWER UNITS OF PAPERMAKING MACHINES

CROSS REFERENCE TO RELATED APPLICATION

This application is a continuation of U.S. application Ser. No. 533,878, filed Sept. 20, 1983, which is now abandoned.

This invention relates to support and drive members for use in, for example, showers such as are used in paper and board making machines. The invention has particular reference to showers for dryer screen conditioning.

Showers for dryer screen conditioning have to work in particularly arduous conditions and must be of a construction that gives easy access to components for replacement and/or repair. A particular problem encountered in the design of showers for dryer screen conditioning is the need to provide a structure which extends across the full width of the dryer screen—a distance that can be as much as 12 m and which can be supported only at its ends. The structure carries a unit supporting one or more spray nozzles that is traversed across some or all of the width of the dryer screen to carry out a required conditioning of the latter. Inevitably, prior art constructions have required a robust structure of considerable size.

It is an object of the present invention to provide a support and drive member particularly for a shower for dryer screen conditioning which is of simplified construction as compared with the prior art and which occupies considerably less space.

According to the present invention, a support and drive member comprises an open framework comprising a helical strip supported by a series of support members that extend longitudinally of the helical strip internally of the latter.

Preferably, the strip is secured directly to the support members.

In one embodiment of the invention, there is provided a tubular housing in which the drive member is coaxially located, means for supporting the member for rotation about its longitudinal axis, means for rotating the member, and a carrier mounted upon the member and adapted to be traversed along the latter as the member is rotated.

The means for rotating the drive member may be a motor housed in an end cap detachably secured to one end of the tubular housing.

A shower unit embodying the invention comprises a tubular housing with a longitudinal slot that extends over part at least of the length of the housing, a support and drive member mounted coaxially within the housing for rotation about its longitudinal axis, the support and drive member comprising an open framework consisting of a helical strip supported by a series of support members that extend longitudinally of the member and internally thereof, means for rotating the member about its longitudinal axis, a carrier mounted upon the member and adapted to be traversed along the latter, a nozzle head including at least one spray nozzle mounted upon the carrier in a position to direct a spray through the slot and means for supplying a treatment fluid to the spray nozzle.

By way of example only, a shower for dryer screen reconditioning will now be described in greater detail with reference to the accompanying drawings of which:

Figure 1:
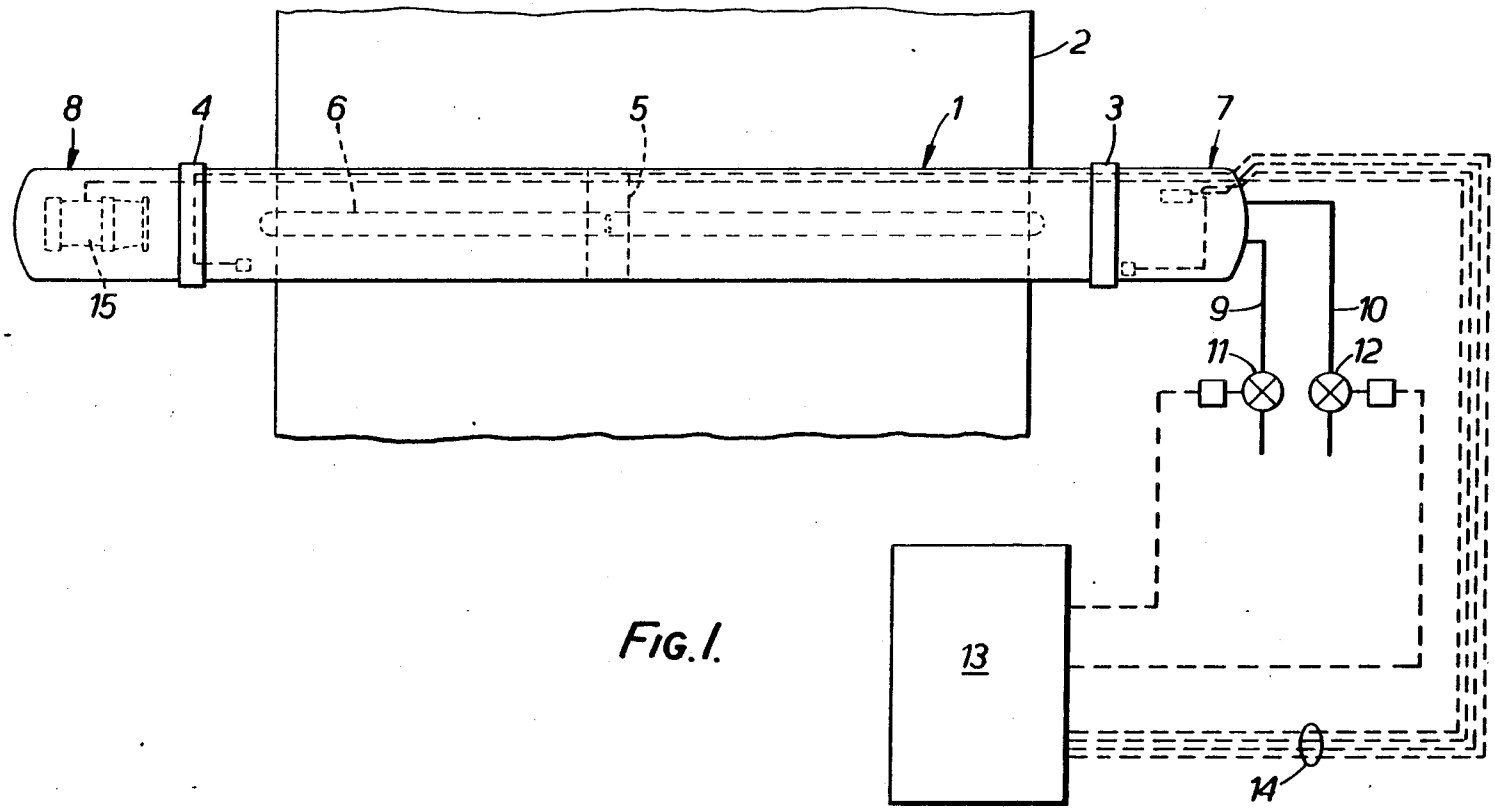
FIG. 1 is a schematic illustration of a complete shower installation.

Referring first to FIG. 1, the shower installation comprises a hollow metal support tube 1 usually of stainless steel that extends across the width of the dryer screen 2 and is carried on brackets 3, 4 each adjacent one side of the screen but outside the width of the latter.

Located within the support tube 1 is a nozzle carrier 5 carrying an air and a water nozzle in side-by-side relationship. The unit 5 is supported inside the tube 1 for movement along the length thereof in a manner to be described in more detail below. The tube 1 has a longitudinal slot 6 in its underneath surface (as seen in FIG. 1) through which exit air and water from the nozzles.

Adjacent the bracket 3 is an end cap 7 also of stainless steel and detachably secured to the tube 1 while a similar cap 8 is detachably secured to the other end of the tube 1 adjacent the bracket 4.

Air and water are supplied to the air and water nozzles via supply lines 9 and 10 respectively, control over the flow being exercised by respective valves 11 and 12, operation of which is controlled from a remote control panel 13. Extending from the panel 13 are control lines 14 over which are sent control signals for operating a drive motor 15 housed in end housing 8 and signals indicating the movement of the unit 5.

Figure 2:
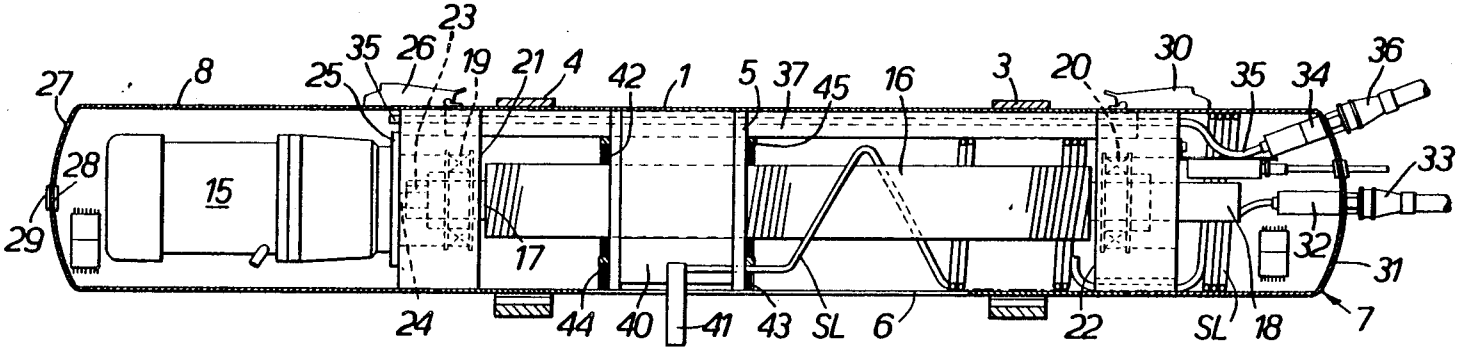
FIG. 2 is a side elevation partly in section of part of the installation.
Figure 3:
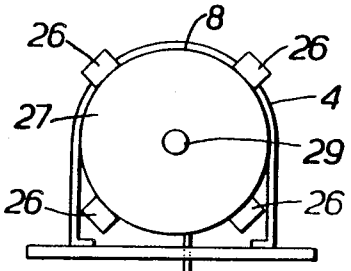
FIG. 3 is an end view of the part shown in FIG. 2.

FIG. 2 shows the tube 1 on a larger scale and it will be seen that there is a driving member 16 mounted coaxially within the tube. Extending from each end of the drive member 15 are stub axles 17, 18 rotatably mounted in bearings 19, 20 carried by bearing housings 21, 22 mounted internally in the tube 1 at the ends thereof.

The hollow outer end of axle 17 is fitted with an internal driving key 23 by means of which the axle is drivingly coupled to the output shaft 24 of driving motor 15 mounted cantilever fashion on an end plate 25 releasably secured to the end face of bearing housing 21.

End cap 8 is held in position at the end of the tube 1 by means of four, equi-spaced releasable, over-centre buckle-type clamps, one, 26, of which is seen in FIG. 2. The domed end 27 of end cap 8 is apertured centrally as at 28 to provide an optional cable entry which when not in use is closed by a plug 29 as shown.

The other end cap 7 is also secured to the adjacent end of tube 1 by means of four releasable clamps and one of these is indicated at 30. The domed end wall 31 of end cap 7 is apertured to accept two end fittings joined inside the end cap to the ends of two coiled flexible tubular supply lines SL. In FIG. 2, only one of the end fittings is seen at 32, the second fitting being immediately beneath fitting 32. Externally of the end cap 7, the end fittings are coupled to quick release connectors which join the fittings to the respective air and water supply lines 9 and 10. One of the quick release connectors is indicated by reference 33.

The domed end 31 is also apertured to receive another end fitting 34 that joins a tube 35 via a quick release coupling 36 to a source of cooling air (not shown). The tube 35 extends longitudinally along inside tube 1 being protected by a hollow cylindrical guide 37 supported between the bearing housings 21. The tube 35 terminates at a point within end cap 8 just beyond bearing housing 21. Also passing through the domed end wall 31 and along guide 36 are the power supply and control cables for motor 15.

Figure 4:
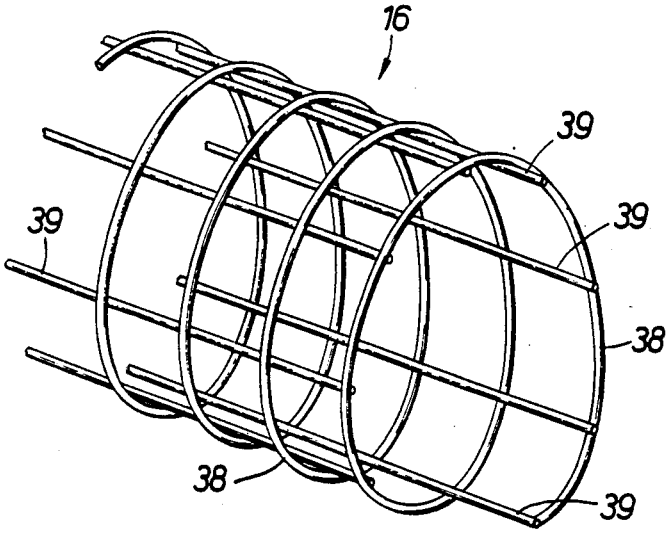
FIG. 4 is a perspective view of part of a component.

Part of the driving member 16 is shown on an enlarged scale in FIG. 4. It comprises a helical strip 38 supported on longitudinally extending supports 39. In the present embodiment, both the strip 38 and the supports 39 are of a suitable grade of stainless steel and the strip is welded to the supports to give a pitch of 8 turns per 5 cm of length. The construction provides a light but very strong support and drive member.

The nozzle carrier 5 is of generally cylindrical form and is made from a plastics material e.g. PTFE. It has a bore screw-threaded to match the pitch of the helical strip 38. The external surface of the cylinder is contoured to provide a flat mounting surface for a nozzle unit 40 carrying a water jet (not shown) and an air nozzle 41. As can be seen from FIG. 2, the nozzle 41 extends through the slot 6. The unit 40 is mounted on the carrier 5 in such manner that the air nozzle can be withdrawn inside the tube 1 for assembly purposes and in circumstances to be described in detail below. The external surface of the carrier 5 has a longitudinal slot to accommodate the guide 37.

The water nozzle is located within the tube 1 and is protected thereby but is positioned so as to be able to discharge a jet of water through the slot 6. The coiled flexible supply lines referred to above are nested round the driving member 16 as can be seen from FIG. 2 and extend along the driving member to the carrier 5 where the air supply line is connected to the air nozzle 41 and the water supply line is joined to the water nozzle.

Also carried by the nozzle carrier 5 are cleaning brushes 42, 43 each comprising radially arranged bristles whose inner ends rub along the surface of the driving member 16 and whose outer ends rub along the inside surface of the tube 1. The bristles are attached to annular carriers 44, 45 that are secured to the end faces of the nozzle carrier as shown in FIG. 2.

In use, rotation of the driving member 16 by the motor 15 causes the nozzle carrier 5 to progress along the length of the driving member. Rotation of the nozzle carrier 5 with the driving member is prevented by the air nozzle 41 which projects through the slot 6.

The control gear associated with the control panel enables a user to select one of a number of operating modes. The nozzle carrier 5 may be required to traverse across the entire width of the dryer screen 2 (FIG. 1) either once or for a specified period or continuously until stopped. The user may require the nozzle carrier to move to and fro across a part only of the screen and this can be achieved by the user first setting the carrier centrally of the required part and then the amplitude of movement required to traverse the carrier along the length of the part.

Controls are also provided to enable a user to select for use either the air nozzle only or the water nozzle only or both.

As has been explained above, the shower works under arduous conditions including exposure to steam and a hot atmosphere. Thus, it is not possible to rely on the conventional techniques for cooling the motor 15. As described above, an external source of cooling air is used to keep the motor cool. Cooling air from the source is fed along tube 35 to the end cap 8 where it is circulated over and through the motor 15 by a circulating fan associated with the motor.

If it becomes necessary to withdraw the driving member for replacement or repair, this can be done by removing the end cap 8 by releasing the buckles 26, uncoupling and removing the motor 15 and then withdrawing the driving member 16 and nozzle carrier. The mounting of the unit 40 enables the nozzle 41 to be withdrawn inside the tube 1 to allow the carrier 5 to be withdrawn from the tube with the driving member. Once the carrier is clear of the tube 1 the air and water supply lines can be uncoupled.

As the nozzle carrier 5 traverses along the driving member 16, the cleaning brushes 42, 43 rub along the surfaces of the member 16 and the inner surface of the tube 1 and remove therefrom any matter that has been deposited thereon. Such removed matter normally falls through the slot 6.

It will be appreciated that the construction described above provides a compact assembly whose working parts are enclosed to give a substantial degree of protection. The form of the driving member 16 provides a substantially rigid support and drive for the nozzle carrier and is of light weight. The driving member is supported at its ends only and does not require any intermediate support.

The support and driving member may be incorporated in other equipment than a shower unit.

We claim:

1. A shower unit comprising:

a tubular housing with a longitudinal slot that extends over part at least of the length of the housing;

bearing supports located in the housing at each end thereof;

a support and drive member mounted in the bearing supports coaxially within the housing for rotation about its longitudinal axis, the support and driving member comprising an open framework consisting of a helical strip supported by a series of support members that extend longitudinally of the member and internally thereof;

respective end caps secured to the housing at each end thereof;

a drive motor housed in one of the end caps for rotating the member about its longitudinal axis;

a carrier mounted upon the helical strip and adapted to be traversed along the latter as the member is rotated;

a nozzle head including at least one spray nozzle mounted upon the carrier in a position to direct a spray through the slot;

means for supplying a treatment fluid to the spray nozzle;

a supply line for connecting a source of cooling air to the said one end cap, the supply line extending to the said one end cap internally of the housing from the other end cap, and a protective guide tube which extends from one bearing support to the other bearing support and within which the supply line is located.

2. A unit as claimed in claim 1 in which the framework carries stub axles that extend from each end thereof and are rotatably mounted in bearings located in the bearing supports.

3. A unit as claimed in claim 2 in which the drive motor is detachably mounted upon the bearing support at one end of the housing and has an output shaft that is releasably coupled to the stub axle that is rotatably mounted in said bearing support.

4. A unit as claimed in claim 1 in which the nozzle head carries at least one nozzle that extends through the slot, the head being mounted upon the carrier in a manner such that the one nozzle is withdrawable into the housing.

5. A unit as claimed in claim 1 in which the means for supplying a treatment fluid comprises, for the or each nozzle, a respective flexible supply line located within the housing and interconnecting the nozzle with a respective inlet for treatment fluid positioned in one of the end caps of the housing.

6. A shower unit comprising:

a tubular housing with a longitudinal slot that extends over part at least of the length of the housing;

a support and drive member mounted coaxially within the housing for rotation about its longitudinal axis, the support and driving member comprising an open framework consisting of a helical strip supported by a series of support members that extend longitudinally of the member and internally thereof;

means for rotating the member about its longitudinal axis;

a carrier mounted upon the helical strip and adapted to be traversed along the latter as the member is rotated;

a nozzle head including at least one spray nozzle mounted upon the carrier in a position to direct a spray through the slot;

means for supplying a treatment fluid to the spray nozzle, and a brush unit or brush units mounted upon the carrier for scouring the external surface of the driving member and the inside face of the housing.

* * * * *